US010703393B2

(12) United States Patent
Longin et al.

(10) Patent No.: US 10,703,393 B2
(45) Date of Patent: Jul. 7, 2020

(54) METHOD TO TRANSPORT GOODS, GOODS-CARRYING RAIL VEHICLE, AND GOODS TERMINAL

(71) Applicant: FORD MOTOR COMPANY, Dearborn, MI (US)

(72) Inventors: David Longin, Herent Flanders (BE); Mark Gijbels, Binkom (BE); Robin Celis, Herent Brabant (BE)

(73) Assignee: Ford Motor Company, Dearborn, MI (US)

( * ) Notice: Subject to any disclaimer, the term of this patent is extended or adjusted under 35 U.S.C. 154(b) by 232 days.

(21) Appl. No.: 15/890,974

(22) Filed: Feb. 7, 2018

(65) Prior Publication Data

US 2018/0222496 A1 Aug. 9, 2018

(30) Foreign Application Priority Data

Feb. 8, 2017 (DE) ..... 10 2017 201 973

(51) Int. Cl.
*B61D 47/00* (2006.01)
*B61L 23/00* (2006.01)
(Continued)

(52) U.S. Cl.
CPC ..... *B61D 47/005* (2013.01); *B61B 1/005* (2013.01); *B61D 3/20* (2013.01); *B61D 47/00* (2013.01);
(Continued)

(58) Field of Classification Search
CPC ..... B61D 47/00; B61D 47/005; B61D 3/20; B61B 1/005; B61L 23/005; B61L 27/04
See application file for complete search history.

(56) References Cited

U.S. PATENT DOCUMENTS 3,386,202 A * 6/1968 Crews ..... G07F 17/145 49/35
3,991,889 A * 11/1976 Cox ..... B61B 1/005 414/339
(Continued)

FOREIGN PATENT DOCUMENTS

DE 1176172 A 8/1964
DE 2054063 A1 6/1971
(Continued)

OTHER PUBLICATIONS

Bearth, Dan, "Google Wins Patent for Autonomous Package-Delivery System," Transport Topics, Feb. 11, 2016, pp. 1-2.
(Continued)

*Primary Examiner* — Jason C Smith
(74) *Attorney, Agent, or Firm* — Gregory P. Brown; Brooks Kushman, P.C.

(57) ABSTRACT

The present disclosure relates to an autonomous rail transport system with the aid of a rail network. The rail transport system according to the disclosure comprises at least one autonomous goods-carrying rail vehicle and at least two autonomous goods terminals. The goods-carrying rail vehicle is designed to transport at least one item of goods while the goods terminals are each designed to receive and/or release at least one item of goods. The item of goods is transported autonomously from a first goods terminal to a second goods terminal with the aid of the goods-carrying rail vehicle on the rail network. The rail network of the rail transport system according to the disclosure is a streetcar-line network.

9 Claims, 5 Drawing Sheets

(51) Int. Cl.
*B61L 27/04* (2006.01)
*B61B 1/00* (2006.01)
*B61D 3/20* (2006.01)

(52) U.S. Cl.
CPC ..... *B61L 23/005* (2013.01); *B61L 27/04* (2013.01); *B61L 2210/02* (2013.01)

(56) References Cited

U.S. PATENT DOCUMENTS 6,401,624 B1 * 6/2002 Nijenhuis ..... B65G 63/025 104/29
6,435,796 B1 * 8/2002 Iversen ..... B63B 25/004 414/139.9
6,990,467 B1 * 1/2006 Kwan ..... G06Q 10/08 705/35
7,991,505 B2 * 8/2011 Lert, Jr. ..... B65G 1/0492 198/347.1
8,784,034 B2 * 7/2014 Lert, Jr. ..... B65G 1/0492 414/807
9,256,852 B1 * 2/2016 Myllymaki ..... G06Q 10/083
2004/0183673 A1 * 9/2004 Nageli ..... G01S 5/0018 340/539.13
2009/0241797 A1 * 10/2009 Costa ..... G06Q 10/08 104/29
2009/0293756 A1 * 12/2009 Hathaway ..... B61B 1/005 104/29
2015/0006005 A1 * 1/2015 Yu ..... G05D 1/0297 701/22
2015/0154557 A1 * 6/2015 Skaaksrud ..... H04W 12/06 705/337

FOREIGN PATENT DOCUMENTS

DE 19626966 A1 1/1998
DE 19802761 A1 7/1999
DE 10124461 C1 7/2002
DE 10162117 A1 7/2003
DE 19711462 B4 4/2005
DE 102012018006 A1 3/2013

OTHER PUBLICATIONS

Bombardier, Charles, "Ecotranzit," Imaginactive, Dec. 8, 2015, Montréal, Québec, Canada pp. 1-2.
https://www.youtube.com/watch?r=3Vl43wA1UrU&ebc=ANyPxKro1ZyersUOJpiO5iQ9WRZST_PeeA49q_xZKxwK4nDgZ-bD31vJMLp7wjWFDNLWwb8gWOKFnJ1SvwEhiUKeToeYa3R8Eg&nohtml5=False.
Imaginactive Ecotransport concepts, http://imaginactive.org/page/2/?lang=ja, pp. 1-19.
https://www.youtube.com/watch?v=SW3o5Mu9wjc.

* cited by examiner

METHOD TO TRANSPORT GOODS, GOODS-CARRYING RAIL VEHICLE, AND GOODS TERMINAL

CROSS-REFERENCE TO RELATED APPLICATIONS

This application claims foreign priority benefits under 35 U.S.C. § 119(a)-(d) to Application DE 10 2017 201 973.5 filed Feb. 8, 2017, which is hereby incorporated by reference in its entirety.

TECHNICAL FIELD

The present disclosure relates to a method to transport goods, a goods-carrying rail vehicle, and goods terminals.

BACKGROUND

In many cities and large conurbations, it is nowadays sought to improve profitability of a city or of a conurbation with the aid of different and varied programs. These include toll zones, emissions-class labels and vehicle-free zones. Such programs assist in reducing the traffic in the inner city or the conurbation and relieving the burden on the environment.

On the other hand, the programs for reducing traffic lead to greater challenges with regard to the delivery of goods, because heavy goods vehicles are subject to ever greater restrictions and constraints. New ways are therefore sought for delivering goods into the center of a city or of a conurbation in an environmentally friendly manner.

U.S. Pat. No. 7,991,505 B2 and U.S. Pat. No. 8,784,034 B2 have disclosed rail-based transport systems for containers or packages within a limited working area. The containers or packages are transported from one location to another location within a limited working area with the aid of autonomously traveling trucks. Here, the trucks automatically receive the containers or packages, transport them to the desired location within the limited working area, and automatically unload them again. Here, the entire transport process is fully computer-aided.

SUMMARY

The objects of the present disclosure are those of providing an advantageous rail transport system, an advantageous goods-carrying rail vehicle, an advantageous goods terminal and an advantageous transport method for transporting goods.

The present disclosure discloses an autonomous rail transport system with the aid of a rail network. The rail transport system according to the disclosure comprises at least one autonomous goods-carrying rail vehicle and at least two autonomous goods terminals. The goods-carrying rail vehicle is designed to transport at least one item of goods while the goods terminals are each designed to receive and/or release at least one item of goods. Here, the item of goods, which may be a sea container, a Euro pallet and/or a package, is transported autonomously from a first goods terminal to a second goods terminal with aid of the goods-carrying rail vehicle on the rail network. The rail network of the rail transport system according to the disclosure is a streetcar-line network.

A streetcar-line network is indispensable in many cities, and in particular in large conurbations. The streetcar-line network runs in a criss-crossing manner and, in so doing, commonly links an inner part of a city to an outer part of a city. Different city districts, such as for example residential, industrial or shopping districts, are connected to one another in the process. The streetcar-line network is more closely integrated into the infrastructure of a city or of a large conurbation than other rail networks. Aside from rails that are reserved exclusively for streetcars, a not inconsiderable part of the streetcar-line network is already integrated into the roads used by motor vehicles. Furthermore, nowadays, the streetcar-line network is also led through parks and over plazas. The mixture of the different streetcar-line routes commonly leads to a rail network with extensive coverage.

According to the disclosure, for the use of a rail transport system according to the disclosure or of the further refinements thereof, an autonomous goods-carrying rail vehicle is provided. The goods-carrying rail vehicle according to the disclosure comprises a good-supporting apparatus that is designed for transporting at least one item of goods. The goods-supporting apparatus can furthermore be aligned and/or inclined relative to a goods terminal. The goods-supporting apparatus can in this case be moved both horizontally and vertically in order to compensate a horizontal and/or vertical offset between the goods-carrying rail vehicle and the goods terminal. Owing to possible unevennesses, it may be necessary for the goods-supporting apparatus of the goods-carrying rail vehicle to demand an inclination relative to the goods terminal, which is not restricted to one direction of rotation. The inclination of the goods-supporting apparatus may be made up of a superposition of the inclinations in all three spatial directions. In a further refinement, not only the goods-supporting apparatus but also the supporting housing or the entire goods-carrying rail vehicle itself may be capable of being aligned and/or inclined.

In one refinement of the present disclosure, the goods-carrying rail vehicle has a delivery apparatus and/or a withdrawal apparatus. The delivery apparatus is designed to convey an item of goods from the goods-carrying rail vehicle to a goods terminal. The withdrawal apparatus is designed to convey an item of goods from a goods terminal to the goods-carrying rail vehicle. The delivery apparatus and the withdrawal apparatus are preferably separate apparatuses. It is alternatively possible for both apparatuses to be integrated together in one apparatus. A delivery and a withdrawal of one or more items of goods would thus be possible with only one apparatus.

An advantageous refinement of the goods-carrying rail vehicle according to the disclosure may be one that has at least one slot in the goods-supporting apparatus.

A further advantageous refinement of the goods-carrying rail vehicle according to the disclosure may be a vehicle-internal drive unit. In this refinement, the goods-supporting apparatus is situated in the vehicle region that is equipped with a drive unit. It is alternatively possible for the goods-supporting apparatus and the drive unit to be arranged in different regions of the vehicle. An example mentioned here is for the goods-supporting apparatus to be integrated into a trailer.

In a further advantageous refinement of the goods-carrying rail vehicle according to the disclosure, the drive unit may be electric. The electric drive unit is advantageous with regard to quiet transport of goods within the city or a large conurbation.

A further advantageous refinement of the goods-carrying rail vehicle according to the disclosure is the connection of the goods-carrying rail vehicle to the electrical line by a pantograph. The use of a pantograph leads to a permanent electrical supply to the goods-carrying rail vehicle according to the disclosure. Alternatively, for example as a backup solution, the goods-carrying rail vehicle may be powered by a battery or an accumulator.

In an advantageous refinement of the goods-carrying rail vehicle according to the disclosure, the latter comprises an actuation module. The actuation module is designed to receive control commands. Here, control commands are for example the movement of the goods-carrying rail vehicle in relation to the goods terminal, and the alignment of the goods-supporting apparatus relative to the goods terminal.

According to the disclosure, for the use of the rail transport system according to the disclosure or of the further refinements thereof, an autonomous goods terminal is provided. The goods terminal according to the disclosure is designed to receive and/or release at least one item of goods. Furthermore, the goods terminal is designed such that it can be aligned and/or inclined relative to a goods-carrying rail vehicle. It is thus possible, in an alternative method according to the disclosure, for the goods terminal to be aligned relative to a goods-carrying rail vehicle, such that there is no need for alignment or inclination of the goods-carrying rail vehicle. Here, the goods terminal is arranged so as to be situated adjacent to a rail line associated with a streetcar-line network. Here, "arranged adjacent to" encompasses any arrangement in which a possible distance between the goods-carrying rail vehicle and the goods terminal can be bridged by a goods conveying appliance assigned to the goods-carrying rail vehicle or to the goods terminal.

In one refinement of the goods terminal according to the disclosure, the latter is characterized by a receiving apparatus and/or a release apparatus. The receiving apparatus is designed to convey an item of goods from a goods-carrying rail vehicle to the goods terminal, whereas the release apparatus is designed to convey an item of goods from the goods terminal to a goods-carrying rail vehicle. In an advantageous refinement, both apparatuses are integrated separately in the goods terminal. It is alternatively possible for the receiving apparatus and the release apparatus to be combined in a single apparatus. A receipt and/or a release of one or more items of goods would thus be possible with only one apparatus.

In one refinement of the present disclosure, the goods terminal according to the disclosure has a notification module. The notification module transmits a message to the customer as soon as an item of goods has been delivered to the goods terminal.

In one refinement of the present disclosure, the goods terminal has an issuing module. An item of goods dispatched by a customer is integrated into the autonomous rail transport system by the issuing module.

In an advantageous refinement of the goods terminal according to the disclosure, the latter has at least one slot.

In an advantageous refinement of the goods terminal according to the disclosure, the latter may have a control module. The control module is designed to receive control commands, for example for the receiving apparatus, the release apparatus, the alignment and the inclination of the goods terminal.

According to the disclosure, for the use of the rail transport system according to the disclosure or of the further refinements thereof, a transport method is provided. In the transport method according to the disclosure, the transport of the at least one item of goods from a first goods terminal according to the disclosure to a second goods terminal according to the disclosure is performed fully automatically with the aid of a goods-carrying rail vehicle according to the disclosure and using a streetcar-line network. By the fully automatic transport of the item of goods, the transport duration is further minimized, and time delays are reduced.

In one refinement of the transport method according to the disclosure, at least one item of goods is conveyed fully automatically from the goods-carrying rail vehicle to the goods terminal and/or from the goods terminal to the goods-carrying rail vehicle. An item of goods dispatched by a first customer can thus be carried through fully automatically until the item of goods is delivered to a second customer.

In one refinement of the transport method according to the disclosure, in the case of at least two items of goods being conveyed from the goods-carrying rail vehicle into the goods terminal, the items of goods may be conveyed at the same time. In the same refinement of the transport method according to the disclosure, in the case of at least two items of goods being conveyed from the goods terminal into the goods-carrying rail vehicle, too, the items of goods may be conveyed at the same time. Owing to the fast timing, an optimization of the loading and unloading process of the goods terminal and of the goods-carrying rail vehicle is necessary. Simultaneous loading, unloading or loading and unloading of the goods terminal and of the goods-carrying rail vehicle is advantageous here.

In one refinement of the transport method according to the disclosure, the goods-carrying rail vehicle can be aligned relative to the goods terminal and/or the goods terminal can be aligned relative to the goods-carrying rail vehicle.

In one refinement of the transport method according to the disclosure, the goods-carrying rail vehicle can be inclined relative to the goods terminal and/or the goods terminal can be inclined relative to the goods-carrying rail vehicle.

The apparatuses for inclination and for alignment are preferably provided in the goods-carrying rail vehicle and in the goods terminal. It is alternatively also possible for only one of the two appliances to have an apparatus for inclination and for alignment.

A further advantage of the capability for alignment and/or inclination of the goods-carrying rail vehicle and/or of the goods terminal is the use of goods-carrying rail vehicles and/or goods terminals of different sizes, which can be integrated into a common rail transport system. Differences in the position and/or in height can then be compensated by means of alignment and/or inclination.

In one advantageous refinement of the transport method according to the disclosure, an item of goods is conveyed from the goods-carrying rail vehicle into the goods terminal and/or from the goods terminal into the goods-carrying rail vehicle by a delivery apparatus or a withdrawal apparatus of the goods-carrying rail vehicle and/or by a release apparatus or a receiving apparatus of the goods terminal. The transport method according to the disclosure is thus capable of conveying items of goods with the aid of only one appliance. The conveyance of the items of goods is performed here only by the goods terminal or only by the goods-carrying rail vehicle.

In an advantageous refinement of the transport method according to the disclosure, the at least one item of goods may be transported in a closed container that protects the item of goods. Furthermore, the transport method according to the disclosure can, in the case of a multiplicity of items of goods, transport each item of goods in a separate container. It is alternatively possible for multiple items of goods to be transported in a single container. The transport of the items of goods in one or more containers protects the item of goods against external action and environmental influences.

Further features, characteristics and advantages of the present disclosure will emerge from the following description of three exemplary embodiments with reference to the appended figures.

DETAILED DESCRIPTION

As required, detailed embodiments of the present disclosure are disclosed herein; however, it is to be understood that the disclosed embodiments are merely exemplary of the disclosure that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Below, three exemplary embodiments of a transport method according to the disclosure for the transportation of items of goods by a goods-carrying rail vehicle according to the disclosure on a streetcar-line network between two goods terminals according to the disclosure will be described on the basis of FIGS. 1 to 5.

Figure 1:
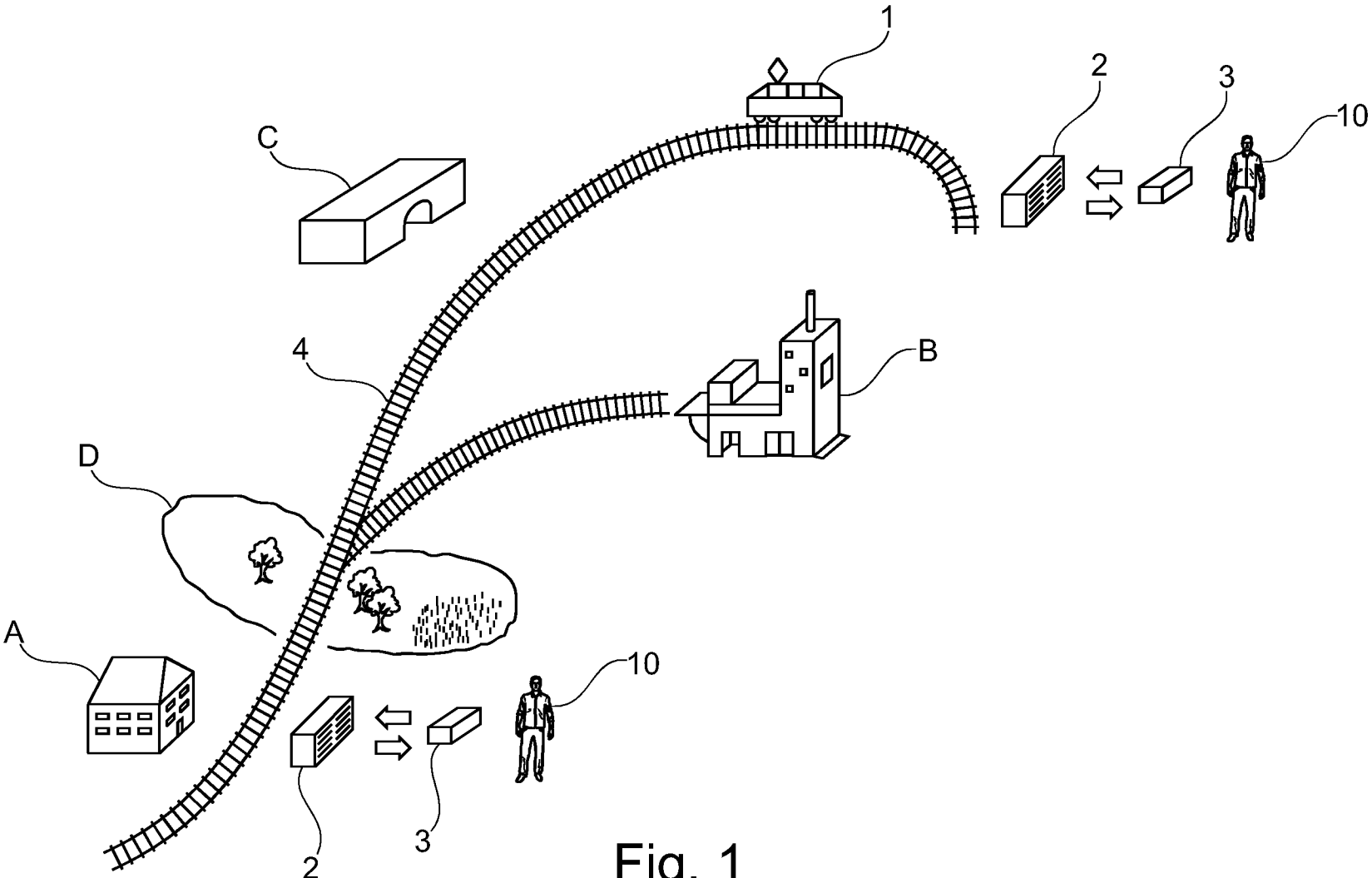
FIG. 1 shows a schematic overview of a first exemplary embodiment of a goods-carrying rail vehicle according to the disclosure on a streetcar-line network with two goods terminals according to the disclosure, wherein the item of goods is a package, and the two goods terminals each form a package station.

FIG. 1 schematically shows a detail of a streetcar-line network 4 such as is constructed in cities or large conurbations. The streetcar-line network 4 runs in a criss-crossing manner through the city and, in the process, connects different city districts. The city districts may be residential districts A, industrial districts B or simply districts C with shopping facilities. Depending on the size of the streetcar-line network 4, the outskirts may be connected to the inner part of a city.

Normally, the streetcar-line network 4 is well integrated into the infrastructure of the city. Here, the streetcar-line network 4 runs not only over areas that are accessible only to streetcars but also over roads that are used by motor vehicles, and through parks D and over plazas. The integration of the streetcar-line network 4 into the infrastructure that is used by other traffic participants often leads to a densely constructed streetcar-line network 4.

Streetcars are typically powered by electric motor. They are environmentally friendly and relatively quiet. Owing to an electrical connection of the streetcars to the electrical supply of the streetcar-line network 4, streetcars have an unlimited range.

An extensive streetcar-line network 4 with an electrically operated streetcar is very well-suited to the establishment of a platform to transport items of goods. An autonomous rail transport system is therefore an excellent environmentally friendly solution for the ever-increasing delivery traffic for the delivery of items of goods within, or between the outskirts and the center of, a city.

FIG. 1 schematically illustrates a first exemplary embodiment of an autonomous rail transport system on a streetcar-line network 4. Here, for a better overview, the goods terminal 2 will be referred to as a package station 2. In this exemplary embodiment, the autonomous rail transport system comprises an autonomous goods-carrying rail vehicle 1 and two autonomous package stations 2. The item of goods 3 to be transported is a package 3, and is being transported once across the city. The package 3 is dispatched in a residential district A and is transported through a park D and past a shopping district C to the outskirts of the city.

A customer 10 who wishes to send a package 3 by the rail transport system according to the disclosure on a streetcar-line network dispatches said package at the first package station 2. The package station 2 is composed of multiple compartments, which are of different sizes. Depending on the size of the package 3 from the customer 10, the package 3 is placed into a compartment, which corresponds to the size of the package 3, of the compartment system of the package station 2. Most compartments of the compartment system of the package station 2 preferably contain a container that protects the package 3 during transport. An issuing module in the package station 2 detects the package 3 that has been dispatched by the customer 10, and integrates the package 3 into the transport sequence.

The further process takes place fully automatically. A goods-carrying rail vehicle 1 travels to the package station 2 containing the package 3, which package station is preferably arranged close to the rail line. The goods-carrying rail vehicle 1 and the package station 2 are then aligned with one another. In the present exemplary embodiment, it is possible for both appliances, both the goods-carrying rail vehicle 1 and the package station 2, to be aligned relative to one another. It is alternatively also possible for only one of the two appliances to be aligned. Here, either the goods-carrying rail vehicle 1 is aligned relative to the package station 2, or the package station 2 is aligned relative to the goods-carrying rail vehicle 1. In the present example, the goods-carrying rail vehicle 1 and the package station 2 are aligned horizontally.

The goods-carrying rail vehicle 1 and the individual package stations 2 in the exemplary embodiment have a multiplicity of compartments. The numbers of compartments of the goods-carrying rail vehicle 1 and of the two package stations 2 are equal in this exemplary embodiment. The numbers of compartments of the individual appliances may alternatively differ. In the present exemplary embodiment, for each individual compartment in the compartment system of the individual appliances, there is a counterpart of a compartment in the compartment system of the respective other appliance. A package 3 of a particular size, that is to say with a particular length, width, height, can then be easily conveyed from the package station into the goods-carrying rail vehicle 1. The package 3 can be conveyed equally easily from the goods-carrying rail vehicle 1 into the package station 2 receiving the package 3. For an efficient transfer of the package 3 from the package station 2 into the goods-carrying rail vehicle 1, and for an efficient transfer of the package 3 from the goods-carrying rail vehicle 1 into the package station 2, the arrangement of the different compartments in the goods-carrying rail vehicle 1 being identical to the arrangement of the different compartments of the respective package station 2 is advantageous. The arrangement of the compartments in the compartment system of the goods-carrying rail vehicle 1 may alternatively differ from the arrangement of the compartments in the compartment system of the respective package station 2. In particular, in the case of multiple packages 3 being received from different package stations 2, the goods-carrying rail vehicle 1 may have a greater number of compartments in the compartment system, and thus also a different arrangement.

For an efficient transfer of the packages 3 from the goods-carrying rail vehicle 1 to the package station 2 and from the package station 2 to the goods-carrying rail vehicle 1, it is advantageous if all packages 3 are transferred simultaneously. Here, either all packages 3 can be transferred from the goods-carrying rail vehicle 1 to the package station 2 simultaneously, or all packages 3 can be transferred from the package station 2 to the goods-carrying rail vehicle 1 simultaneously. Alternatively, it is possible for all packages 3 in the package station 2 and all packages 3 in the goods-carrying rail vehicle 1 to be jointly transferred simultaneously to the respective other appliance.

Different apparatuses are provided for the transfer of the packages 3 between the respective two appliances. In the present exemplary embodiment, apparatuses that convey the packages 3 are provided both in the goods-carrying rail vehicle 1 and in the package station 2. Here, the packages 3 are transferred by the release apparatus of the package station 2 to the goods-carrying rail vehicle 1. During the transfer of the packages 3 from the goods-carrying rail vehicle 1 to the respective package station 2, the delivery apparatus of the goods-carrying rail vehicle 1 performs the conveyance. It is alternatively also possible for the goods-carrying rail vehicle 1 alone to perform the conveyance of the packages 3. For this purpose, the goods-carrying rail vehicle 1 has the delivery apparatus and a withdrawal apparatus, which may be combined in a single apparatus. The delivery apparatus transfers the packages 3 from the goods-carrying rail vehicle 1 to the respective package station 2, wherein the withdrawal apparatus transfers the packages 3 from the respective package station 2 to the goods-carrying rail vehicle 1. In a further alternative, it is also possible for the goods-carrying rail vehicle 1 not to have an apparatus that conveys the packages 3, and for the respective package station 2 to have a release apparatus and a receiving apparatus. The release apparatus is designed to transfer the respective packages 3 from the package station 2 to the goods-carrying rail vehicle 1. The receiving apparatus is designed to transfer the respective packages 3 from the goods-carrying rail vehicle 1 to the package station 2. In all embodiments, the transfer of the packages 3 is fully automated.

In this exemplary embodiment, the individual packages 3 are transported in separate containers. Thus, each individual package 3 is separately protected during transport. It is alternatively also possible for multiple packages 3 to be transported in one relatively large container.

As soon as the respective package 3 has arrived at the package station 2 for delivery, a message is transmitted to the respective customer 10. The transmission regarding the receipt of the package 3 is output by a notification module of the package station 2. The customer 10 is thereby informed that a package 3 in the respective package station 2 is ready for him or her to collect.

Figure 2:
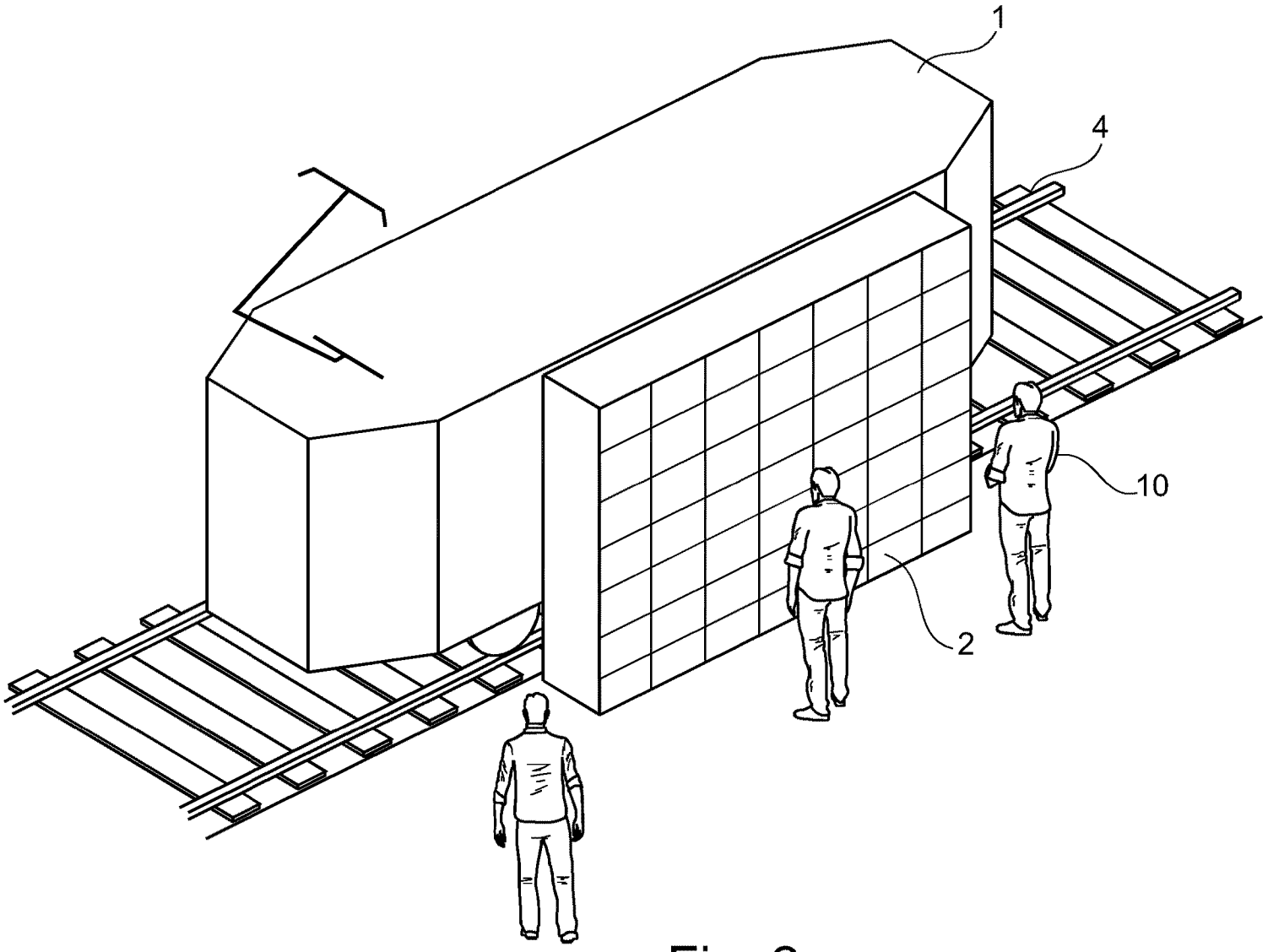
FIG. 2 shows a schematic overview of the first exemplary embodiment with a goods-carrying rail vehicle on a streetcar-line network and with a package station as goods terminal.
Figure 3:
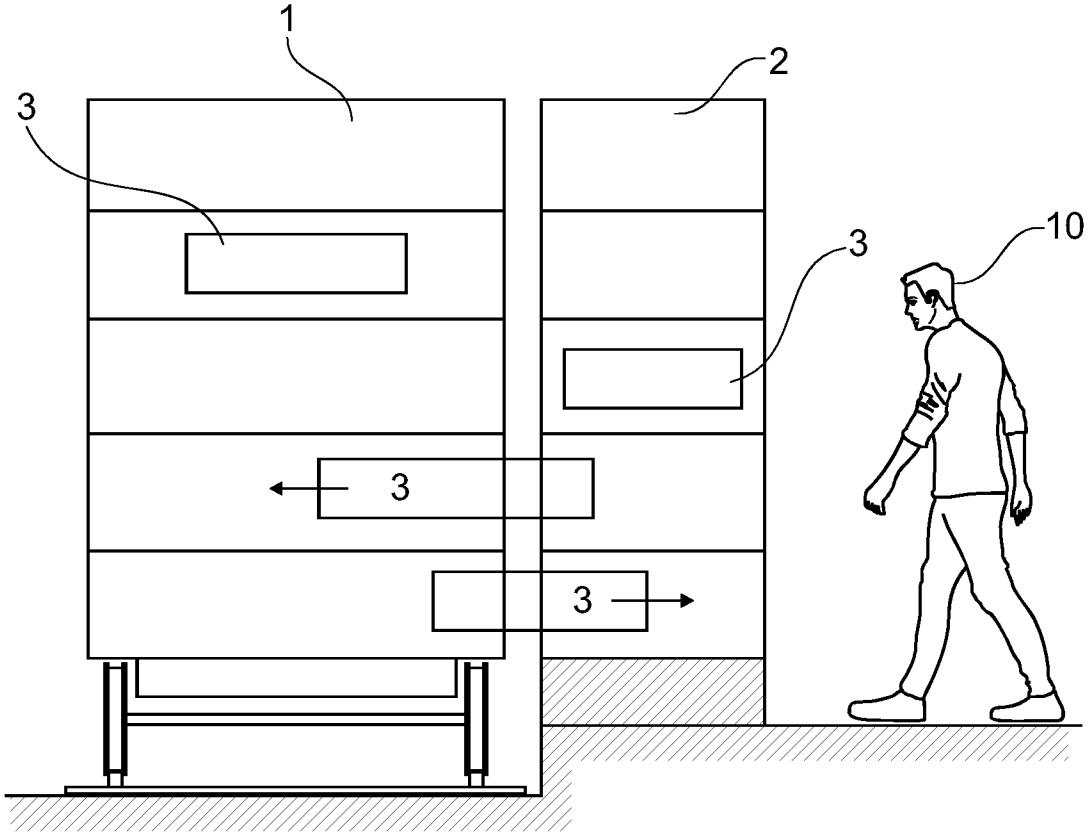
FIG. 3 shows a schematic side view of the first exemplary embodiment with a goods-carrying rail vehicle on a streetcar-line network, multiple packages as items of goods, and a package station as goods terminal.

While FIG. 2 shows a schematic, detailed overview of the first exemplary embodiment, FIG. 3 schematically shows the arrangement of the package station 2 according to the disclosure relative to the goods-carrying rail vehicle 1 according to the disclosure from a lateral perspective. It can firstly be seen here that the package station 2 is arranged close to the rail line. It can secondly be seen that, in the goods-carrying rail vehicle 1 and in the package station 2, there is in each case one package 3 that is merely being stored and will be conveyed at a later point in time. Two further packages 3 can be seen that are currently being transferred from one appliance to the respective other appliance. The package 3 just dispatched by the customer 10 is being transferred from the package station 2 to the goods-carrying rail vehicle 1. The package 3 addressed to the customer 10 is being transferred from the goods-carrying rail vehicle 1 to the package station 2.

Figure 4:
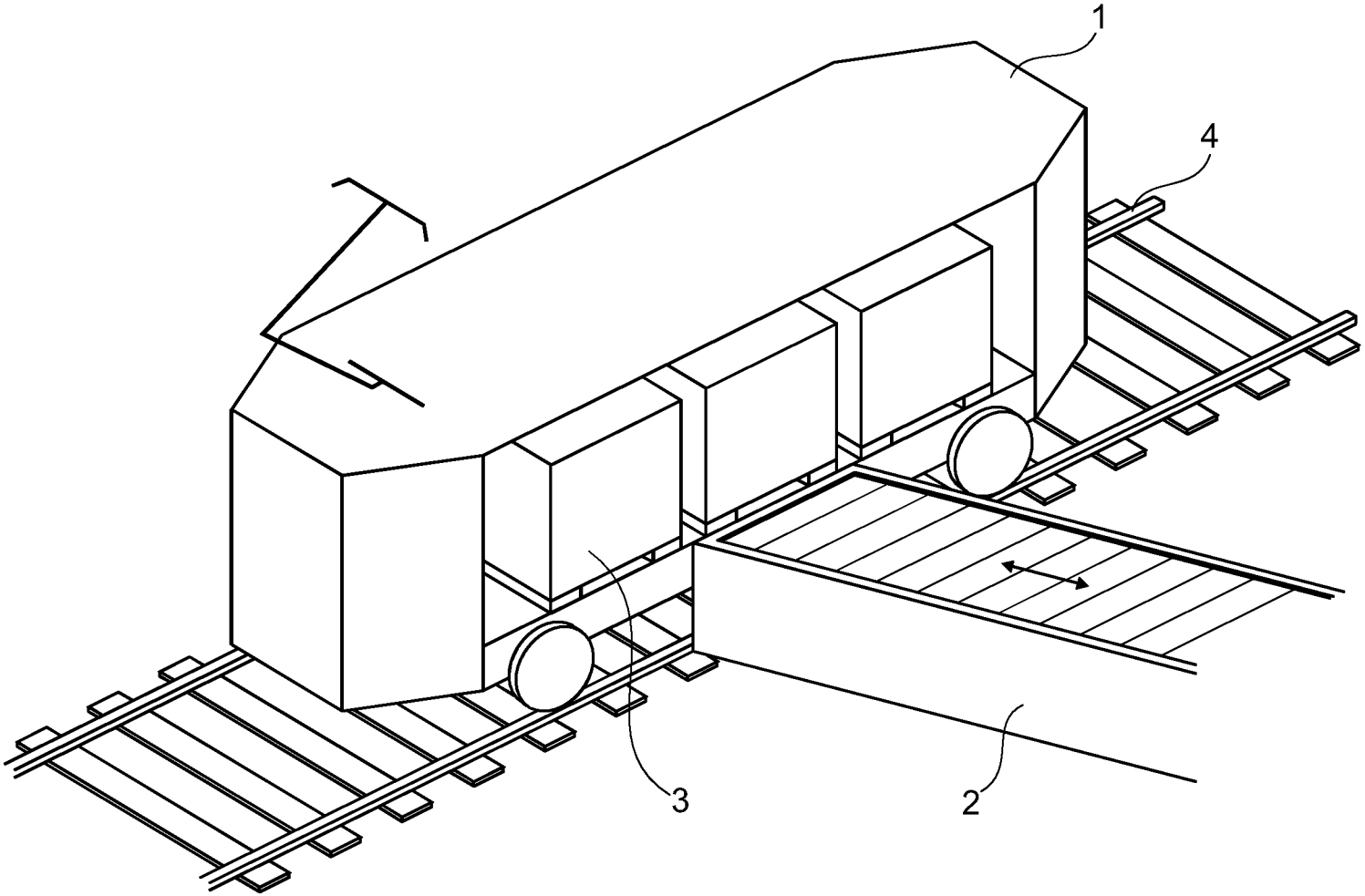
FIG. 4 shows a schematic overview of a second exemplary embodiment with a goods-carrying rail vehicle on a streetcar-line network, multiple Euro pallets as items of goods, and a pallet conveyor installation as goods terminal.

FIG. 4 illustrates a second exemplary embodiment of an autonomous rail transport system to transport Euro pallets 3 with the aid of a streetcar-line network 4. Here, for a better overview, the goods terminal 2 will be referred to as a pallet conveyor installation 2. In this exemplary embodiment, the customer 10 is an owner of a business. The customer 10 loads a container carried by a Euro pallet 3, and places the Euro pallet 3 onto the pallet conveyor installation 2. By the issuing module, the Euro pallet 3 is integrated into the autonomous rail transport system on a streetcar-line network 4. The pallet conveyor installation 2 is arranged directly at the rail line of the streetcar-line network 4. A goods-carrying rail vehicle 1 is configured with a goods-supporting apparatus designed to transport Euro pallets 3 stops directly adjacent to the pallet conveyor installation 2. In this exemplary embodiment, the pallet conveyor installation 2 is designed to release and receive Euro pallets 3. The pallet conveyor installation 2 accordingly corresponds to an apparatus that combines the receiving apparatus and the release apparatus in one. Furthermore, in this exemplary embodiment, no delivery apparatus or withdrawal apparatus is provided in the goods-carrying rail vehicle 1.

As soon as the goods-carrying rail vehicle 1 stops adjacent to the pallet conveyor installation 2, the pallet conveyor installation 2 is aligned correspondingly to a height of the goods-supporting apparatus of the goods-carrying rail vehicle 1, and is inclined if necessary. In this exemplary embodiment, the goods-supporting apparatus of the goods-carrying rail vehicle 1 is not designed for inclination or for alignment. As soon as the pallet conveyor installation 2 has been aligned and/or inclined relative to the goods-carrying rail vehicle 1, the Euro pallet 3 is conveyed into the goods-supporting apparatus of the goods-carrying rail vehicle 1. The alignment of the pallet conveyor installation 2 and the conveyance of the Euro pallet 3 into the goods-supporting apparatus of the goods-carrying rail vehicle 1 is performed fully automatically.

During the further course of the transport method, the goods-carrying rail vehicle 1 travels fully autonomously to a further pallet conveyor installation 2. There, after alignment and inclination of the pallet conveyor installation 2, the goods-carrying rail vehicle 1 is unloaded. Said second pallet conveyor installation 2 is situated either within the city or on the outskirts of the city. When a Euro pallet 3 arrives, the business or the warehouse is notified with the aid of the notification module of the pallet conveyor installation 2.

By the autonomous rail transport system for Euro pallets 3 with the aid of a streetcar-line network 4, it is possible for goods to be sent from one business to another business within a city. It is furthermore possible with the autonomous rail transport system for Euro pallets 3 with the aid of a streetcar-line network 4 for businesses within a city to be connected to warehouses on the outskirts of the city. The supply to businesses by Euro pallets 3 is thus performed fully automatically.

Figure 5:
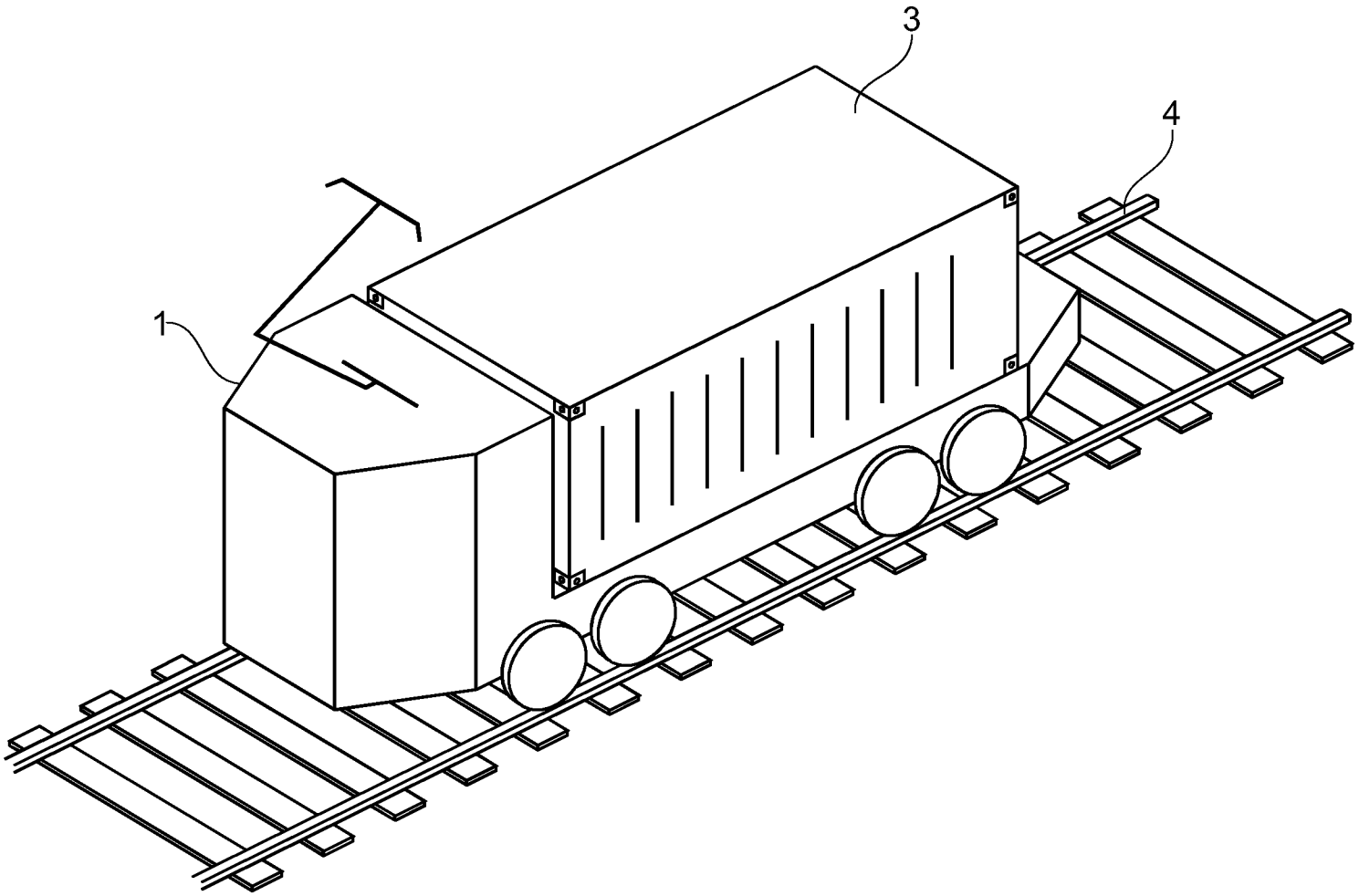
FIG. 5 shows a schematic overview of a third exemplary embodiment with a goods-carrying rail vehicle on a streetcar-line network and with a sea container as an item of goods.

FIG. 5 illustrates a third exemplary embodiment of an autonomous rail transport system to transport sea containers 3 with the aid of a streetcar-line network 4. Here, for a better overview, the goods terminal 2 will be referred to as a crane apparatus (not illustrated in the figure). The autonomous rail transport system to transport sea containers 3 is reserved more for the transport of goods on the outskirts of a city. In this exemplary embodiment, goods for international transport are compiled in sea containers 3 and, the autonomous rail transport system to transport sea containers 3 with the aid of a streetcar-line network 4, are transported from a factory to a warehouse that processes the international transport.

The loading of the goods-supporting apparatus of the goods-carrying rail vehicle 1 is performed with the aid of a first crane apparatus.

After fully automated loading of the goods-carrying rail vehicle 1, the sea container 3 is transported fully automatically to a second crane apparatus in a warehouse. The second crane apparatus is arranged directly at the rail line of the streetcar-line network 4. When the goods-carrying rail vehicle 1 arrives at the second crane apparatus, the arm of the crane apparatus is aligned and inclined. The arm of the crane apparatus is in this case the receiving apparatus and the release apparatus combined in one apparatus. The unloading of the sea container 3 from the goods-carrying rail vehicle 1 is performed fully automatically.

When the sea container 3 is dispatched, the sea container 3 is, in the issuing module of the first crane apparatus, integrated into the autonomous rail transport system on a streetcar-line network 4. Upon the arrival of the sea container 3, the warehouse is notified with the aid of the notification module of the second crane apparatus, such that continuing, fully automatic goods turnover is possible.

With the autonomous rail transport system to transport sea containers 3 on a streetcar-line network 4, warehouses can be connected to factories on the outskirts of a city in an efficient and environmentally friendly manner.

The autonomous rail transport system to transport packages 3, Euro pallets 3 and sea containers 3 allows the customers 10 to dispatch and receive goods or products at any time of the day or night, in accordance with the demands of the customer 10.

The present disclosure has been discussed in detail on the basis of three exemplary embodiments for illustrative purposes. A person skilled in the art will however identify that deviations from the exemplary embodiments are possible, and features of the individual alternatives may be combined with one another. The disclosure is therefore intended to be restricted not exclusively to the described exemplary embodiments, but rather only by the appended claims.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. An autonomous rail transport system comprising:

an autonomous rail vehicle that autonomously transports an item of goods along a rail line of a streetcar-line rail network; and two autonomous terminals that receive and release the item of goods, the goods being transportable autonomously on the rail line from a first goods terminal to a second goods terminal via the rail vehicle, wherein the autonomous rail vehicle includes a goods-supporting apparatus that transports the item of goods to and is aligned and inclined relative to one of the first or second goods terminals;

a receiving apparatus that conveys the item of goods from the rail vehicle to the first goods terminal, and a release apparatus that conveys an item of goods from the second goods terminal to the rail vehicle, wherein the first and second goods terminals are configured to receive and release the item of goods, arranged adjacent to the rail line associated with the streetcar-line network, and is aligned and inclined relative to the rail vehicle.

2. The autonomous rail transport system as claimed in claim 1, wherein the item of goods includes a sea container, a Euro pallet and/or a package.

3. The autonomous rail transport system as claimed in claim 1 further comprising a housing that supports the goods-supporting apparatus, and the rail vehicle as a whole, aligned and inclined relative to the first or second goods terminal.

4. The autonomous rail transport system as claimed in claim 1, wherein the first and second goods terminals include a notification module to transmit a message to a customer after delivery of the item of goods into the first or second goods terminal.

5. The autonomous rail transport system as claimed in claim 1, wherein the first and second goods terminals include an issuing module to integrate the item of goods dispatched by a customer into the rail network.

6. A transport method, comprising:

transporting an item of goods on an autonomous rail vehicle along a rail line of a streetcar-line rail network to one of at least two autonomous terminals;

receiving and releasing the item of goods from the two autonomous terminals such that the item of goods is transportable autonomously on the rail line from a first goods terminal to a second goods terminal via the rail vehicle on the rail network;

automatically conveying the item of goods from the rail vehicle to the first goods terminal and from the second goods terminal to the rail vehicle;

aligning and inclining a goods-supporting apparatus of the rail vehicle relative to the first goods terminal; and aligning and inclining the second goods terminal relative to the goods-supporting apparatus of the rail vehicle.

7. The transport method as claimed in claim 6 further comprising simultaneously conveying at least two items of goods from the rail vehicle to the first goods terminal, and from the second goods terminal to the rail vehicle.

8. A streetcar-line rail network comprising:

an autonomous rail vehicle that autonomously transports an item of goods on a rail line using a support apparatus supported by a housing; and first and second goods terminals that receive and release the item of goods from the housing of the support apparatus, the housing being aligned and inclined relative to first or second goods terminals, wherein the support apparatus includes a delivery apparatus to convey the item of goods from the rail vehicle to the first goods terminal, and a withdrawal apparatus to convey the item of goods from the second goods terminal to the rail vehicle, a notification system in communication with each of the first and second goods terminals and configured to transmit a message to a customer after delivery of the item of goods into the first or second terminal; and an issuing system in communication with each of the first and second goods terminals and configured to integrate the item of goods dispatched by a customer into the rail line.

9. The streetcar-line rail network as claimed in claim 8, wherein the item of goods includes a sea container, a Euro pallet or a package.

* * * * *